US011721538B2

(12) United States Patent
McAlister

(10) Patent No.: US 11,721,538 B2
(45) Date of Patent: Aug. 8, 2023

(54) FEEDING REAL TIME SEARCH RESULTS OF CHIMERIC MS2 SPECTRA INTO THE DYNAMIC EXCLUSION LIST

(71) Applicant: Thermo Finnigan LLC, San Jose, CA (US)

(72) Inventor: Graeme C. McAlister, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 111 days.

(21) Appl. No.: 16/950,310

(22) Filed: Nov. 17, 2020

(65) Prior Publication Data

US 2022/0157593 A1 May 19, 2022

(51) Int. Cl.

| | |
|---|---|
| ***H01J 49/42*** | (2006.01) |
| ***H01J 49/00*** | (2006.01) |
| ***H01J 49/04*** | (2006.01) |

(52) U.S. Cl.

CPC ..... *H01J 49/427* (2013.01); *H01J 49/0054* (2013.01); *H01J 49/0431* (2013.01)

(58) Field of Classification Search

CPC .. H01J 49/427; H01J 49/0054; H01J 49/0431; H01J 49/0036; H01J 49/0045

See application file for complete search history.

(56) References Cited

U.S. PATENT DOCUMENTS

| | | | | |
|---|---|---|---|---|
| 8,110,793 | B2 | 2/2012 | Zubarev et al. | |
| 9,040,903 | B2 * | 5/2015 | Coon | H01J 49/0027 250/281 |
| 9,897,581 | B1 | 2/2018 | Prakash et al. | |
| 10,082,490 | B1 * | 9/2018 | Prakash | G01N 30/7233 |
| 10,128,093 | B2 | 11/2018 | Tate et al. | |
| 2015/0279644 | A1 | 10/2015 | Bonner et al. | |
| 2018/0166265 | A1 * | 6/2018 | Geromanos | G01N 33/68 |
| 2020/0286721 | A1 | 9/2020 | Meissner et al. | |
| 2021/0225627 | A1 | 7/2021 | Xuan | |

OTHER PUBLICATIONS

Diament et al, "On the Feasiblity and Utility of Exploiting Real-Time Database Search to Improve Adaptive Peak Selection", arXiv: 1207.5848v1 [q-bio.QM], URL:http://arxiv.org/abs/1207.5848. (2012), 15 pgs.) (Year: 2012).*

(Continued)

*Primary Examiner* — David E Smith

(57) ABSTRACT

A method includes obtaining a first mass spectrum; selecting a first peak of the first mass spectrum; isolating precursor ions in an isolation window including the first peak; fragmenting and analyzing the isolated ions to obtain a second mass spectrum; performing a real-time search of the second mass spectrum for both the target precursor and near isobaric precursors ions that are co-isolated with the target precursor in an isolation window; adding the precursor ions that produced an identification during the real-time search to the exclusion list; selecting a second peak present in the first mass spectrum and not on the exclusion list; and fragmenting and analyzing ions of the second peak to obtain a third mass spectrum.

16 Claims, 10 Drawing Sheets

(56) References Cited

OTHER PUBLICATIONS

Diament et al., "On the feasibility and utility of exploiting real timedatabase search to improve adaptive peak selection", arXiv:1207.5848v1 [q-bio.QM], URL: https://arxiv.org/abs/1207.5848, (2012), 15 pages.
Pelletier et al., "MealTime-MS: A Machine Learning-Guided Real-Time Mass Spectrometry Analysis for Protein Identification and Efficient Dynamic Exclusion", J. Am. Soc. Mass Spectrom. 2020, 31, 1459-1472.
Zhang, "Automated Precursor Ion Exclusion During LC-MS/MS Data Acquisition for Optimal Ion Identification", J. Am. Soc. Mass Spectrom. (2012) 23:1400-1407.
Shteynberg D., et al., "reSpect: Software for Identification of High and Low Abundance Ion Species in Chimeric Tandem Mass Spectra," Journal of the American Society For Mass Spectrometry, Sep. 29, 2015, vol. 26, No. 11, XP036066353, pp. 1837-1847.
Wang J., et al., "Peptide Identification by Database Search of Mixture Tandem Mass Spectra," Molecular & Cellular Proteomics, Aug. 23, 2011, vol. 10, No. 12, XP55911435, pp. 1-11.
Zhang N., et al., "ProbIDtree: An Automated Software Program Capable of Identifying Multiple Peptides from a Single Collision-Induced Dissociation Spectrum Collected by a Tandem Mass Spectrometer," Proteomics, Oct. 27, 2005, vol. 5, No. 16, XP55911359, pp. 4096-4106.

* cited by examiner

FEEDING REAL TIME SEARCH RESULTS OF CHIMERIC MS2 SPECTRA INTO THE DYNAMIC EXCLUSION LIST

FIELD

The present disclosure generally relates to the field of ion chromatography including feeding real time search results of chimeric MS spectra into the dynamic exclusion list.

INTRODUCTION

Mass spectrometers are often coupled with chromatography systems in order to identify and characterize eluting species from a test sample. In such a coupled system, the eluent is ionized, and a series of mass spectral scans are obtained for subsequent data analysis. As the test sample may contain many species or compounds, it is often desirable to be able to automatically determine or identify species or compounds of interest as they elute and to use those identifications to inform subsequent tandem mass spectra collection.

Tandem mass spectrometry, referred to as MSn, is a popular and widely used analytical technique whereby precursor ions derived from a sample are subjected to fragmentation under controlled conditions to produce product ions. Tandem mass spectrometry is a mode of operation that utilizes multiple stages of mass analysis with a collision or reaction process between each stage of mass analysis. Often this collision or reaction process is preceded by an ion selection step where one or more ions are isolated from the other precursor ions of the parent ion generation. The coupling of multiple stages of mass analysis provides the ability to determine or identify species or compounds of interest by providing additional information on the fragmentation or reaction characteristics of the compound. The product ion spectra contain information that is useful for structural elucidation and for identification of sample components with high specificity. Tandem mass spectrometry having two stages of mass analysis is typically referred to as MS/MS or MS2.

In data dependent mode, the eluting sample is automatically analyzed by the mass spectrometer. A parent scan is first collected. Often this parent scan is simply an MS1 scan of all the species present in the ionized eluent. Using various algorithms and criteria, the mass spectrometer identifies ions in the parent scan for subsequent analysis by MS2. In some data dependent mass spectrometer methods, the instrument may then identify product ions in the MS2 scan for further analysis by higher order MSn scans. The criteria used for precursor ion identification can be as simple as an intensity threshold or a charge state requirement. Or it may involve more complex filtering such as a dynamic exclusion list where ions previously selected for MSn analysis are excluded form additional MSn analysis for a user defined period of time.

In a typical MS2 experiment, the number of precursors that can be analyzed is limited by the chromatographic peak width and the time it takes the mass spectrometer to collect MS2 scans. From the foregoing it will be appreciated that a need exists for minimizing redundancies in the data collected during a data dependent MS2 analysis.

SUMMARY

In a first aspect, a method can include obtaining a first mass spectrum; selecting a first peak of the first mass spectrum; isolating precursor ions in an isolation window including the first peak; fragmenting and analyzing the isolated ions to obtain a second mass spectrum; performing a real-time search of the second mass spectrum for both the target precursor and near isobaric precursors ions that are co-isolated with the target precursor in an isolation window; adding the precursor ions that produced an identification during the real-time search to the exclusion list; selecting a second peak present in the first mass spectrum and not on the exclusion list; and fragmenting and analyzing ions of the second peak to obtain a third mass spectrum.

In various embodiments of the first aspect, the isolation window can have a width of less than about 10 m/z.

In various embodiments of the first aspect, the target precursor can be added to the exclusion list when the target precursor is not identified during the real-time search.

In various embodiments of the first aspect, prior to selecting the first peak of the first mass spectrum, the method can further include isolating precursor ions in a second isolation window having a width greater than a width of the isolation window; fragmenting and analyzing the isolated ions to obtain a fourth mass spectrum; performing a real-time search of the fourth mass spectrum for a set of precursor ions co-isolated in the second isolation window; and adding the set of precursor ions to an exclusion list. In particular embodiments, the width of the second isolation window can be at least about 4 m/z. In various embodiments, wherein the second isolation window can be selected in a data-independent manner. In various embodiments, the second isolation window can be selected based on the location of a plurality of peaks in first mass spectrum. In particular embodiments, the second isolation window can be selected based on the number of precursor ion peaks within the second isolation window. In particular embodiments, the second isolation window can be selected based on the precursor ion flux isolated with the second isolation window.

In a second aspect, a method can include isolating precursor ions in a first isolation window having a first width; fragmenting and analyzing the isolated ions to obtain a first mass spectrum; performing a real-time search of the first mass spectrum for a first set of precursor ions co-isolated in the first isolation window; adding precursor ions in the first set that produced an identification during the real-time search to an exclusion list; selecting an unidentified precursor peak not on the exclusion list; isolating precursor ions in a second isolation window having a second width, the second width narrower than the first width and centered on the unidentified precursor peak; fragmenting and analyzing the isolated ions to obtain a second mass spectrum; performing a real-time search of the second mass spectrum for both the target precursor and near isobaric precursors ions that have been co-isolated with the target precursor in an isolation window; removing features corresponding to fragments of the second set of precursor ions from the first mass spectrum to obtain a reduced mass spectrum; performing a real-time search of the reduced mass spectrum for a third set of precursor ions co-isolated in the first isolation window; adding precursor ions that produced an identification from the first, second, and third set to the exclusion list; selecting a second unidentified peak not on the exclusion list; and fragmenting and analyzing ions of the second unidentified peak to obtain a third mass spectrum.

In various embodiments of the second aspect, the target precursor can be added to the exclusion list when the target precursor is not identified by the real-time search.

In various embodiments of the second aspect, the second isolation window can at least partially overlap the first isolation window In various embodiments of the second aspect, the first isolation window can be determined in a data-independent manner.

In various embodiments of the second aspect, the first isolation window can be selected based on the location of a plurality of peaks in a survey scan. In particular embodiments, the first isolation window can be selected based on the number of precursor ion peaks within the first isolation window. In particular embodiments, wherein the first isolation window is selected based on the precursor ion flux isolated with the first isolation window.

In a third aspect, a mass spectrometer can include an ion source configured to ionize a sample to produce ions; a mass analyzer configured to produce mass spectra; and a controller. The controller can be configured to obtain a first mass spectrum; select a first peak of the first mass spectrum; isolate precursor ions in an isolation window including the first peak; fragment and analyze the isolated ions to obtain a second mass spectrum; perform a real-time search of the second mass spectrum for both the target precursor and near isobaric precursors ions that have been co-isolated with the target precursor in an isolation window; add the precursor ions that produced an identification during the real-time search to the exclusion list; select a second peak present in the first mass spectrum and not on the exclusion list; and fragment and analyzing ions of the second peak to obtain a third mass spectrum.

In various embodiments of the third aspect, the isolation window can have a width of less than about 10 m/z.

In various embodiments of the third aspect, the controller can be further configured to, prior to selecting the first peak of the first mass spectrum, isolate precursor ions in a second isolation window having a width greater than a width of the isolation window; fragment and analyzing the isolated ions to obtain a fourth mass spectrum; perform a real-time search of the fourth mass spectrum for a set of precursor ions co-isolated in the second isolation window; and add the set of precursor ions to an exclusion list. In particular embodiments, the width of the second isolation window can be at least about 4 m/z. In particular embodiments, the second isolation window can be selected in a data-independent manner. In particular embodiments, the second isolation window can be selected based on the location of a plurality of peaks in first mass spectrum. In more particular embodiments, the second isolation window can be selected based on the number of precursor ion peaks within the second isolation window. In more particular embodiments, the second isolation window can be selected based on the precursor ion flux isolated with the second isolation window.

DRAWINGS

For a more complete understanding of the principles disclosed herein, and the advantages thereof, reference is now made to the following descriptions taken in conjunction with the accompanying drawings, in which.

Figure 3A:
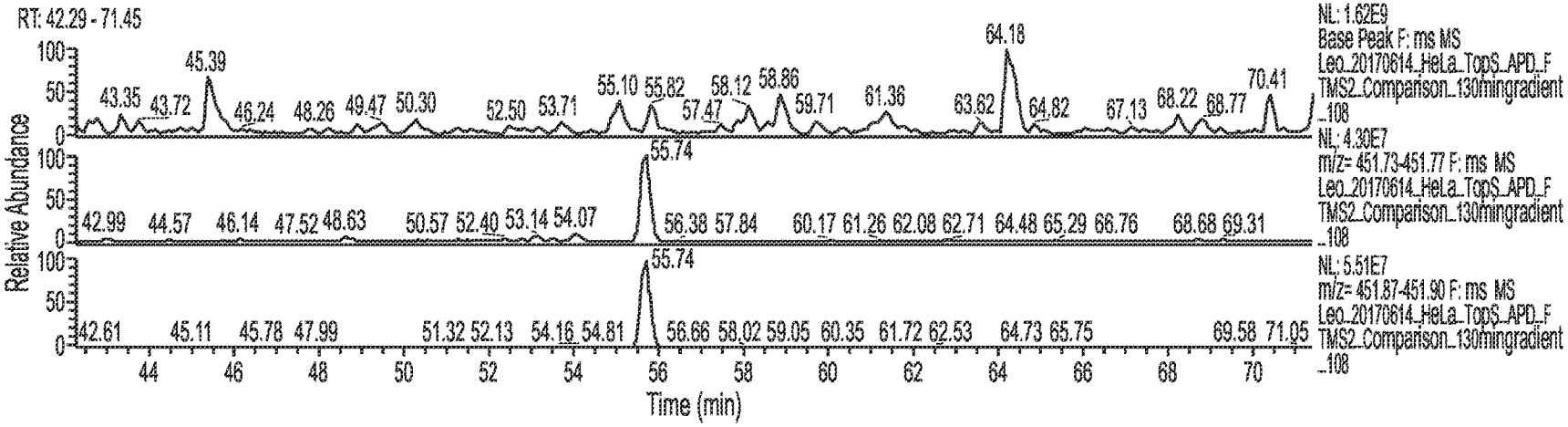

FIG. 3A a base peak chromatogram and two selected ion chromatograms for 451.74 and 451.89 m/z.

FIGS. 3B, 3C, 3D, 3E, and 3F are mass spectra of the Full MS scan, and the MS2 spectra illustrating data dependent analysis of the 451.74 and 451.89 m/z precursor ions.

Figure 4:
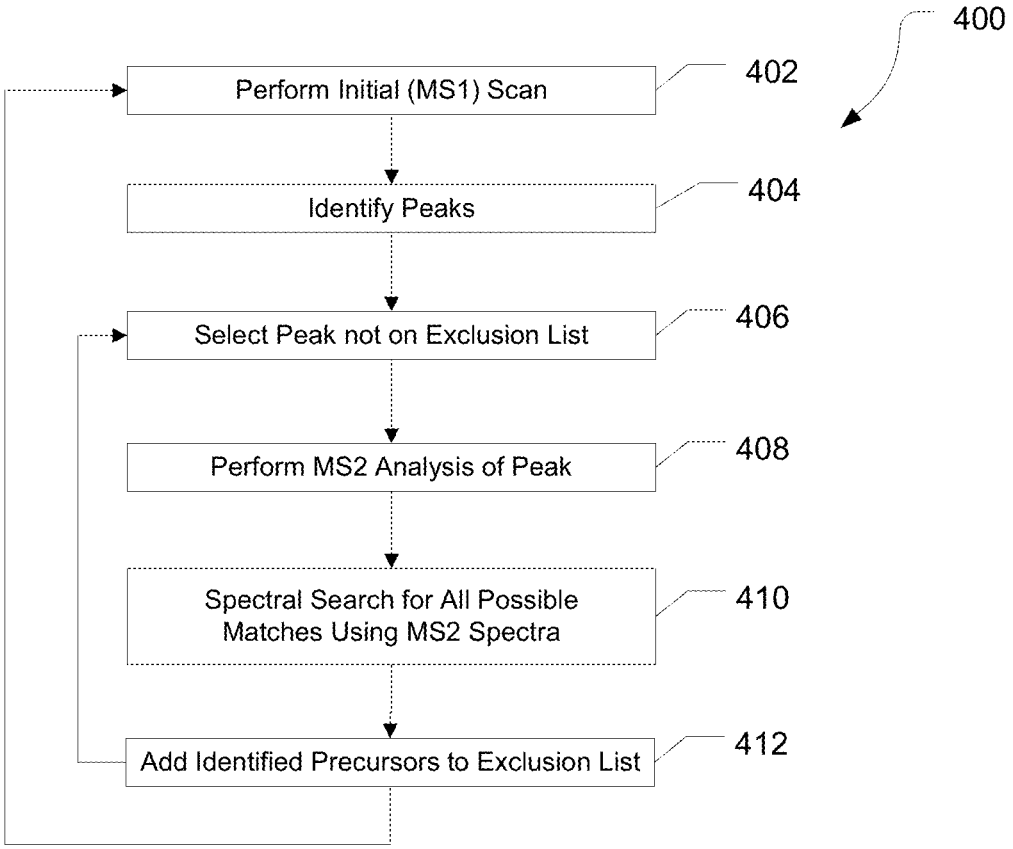

FIG. 4 is a flow diagram illustrating a method data dependent analysis using real time search results to identify additional precursors in chimeric spectra, in accordance with various embodiments.

Figure 5:
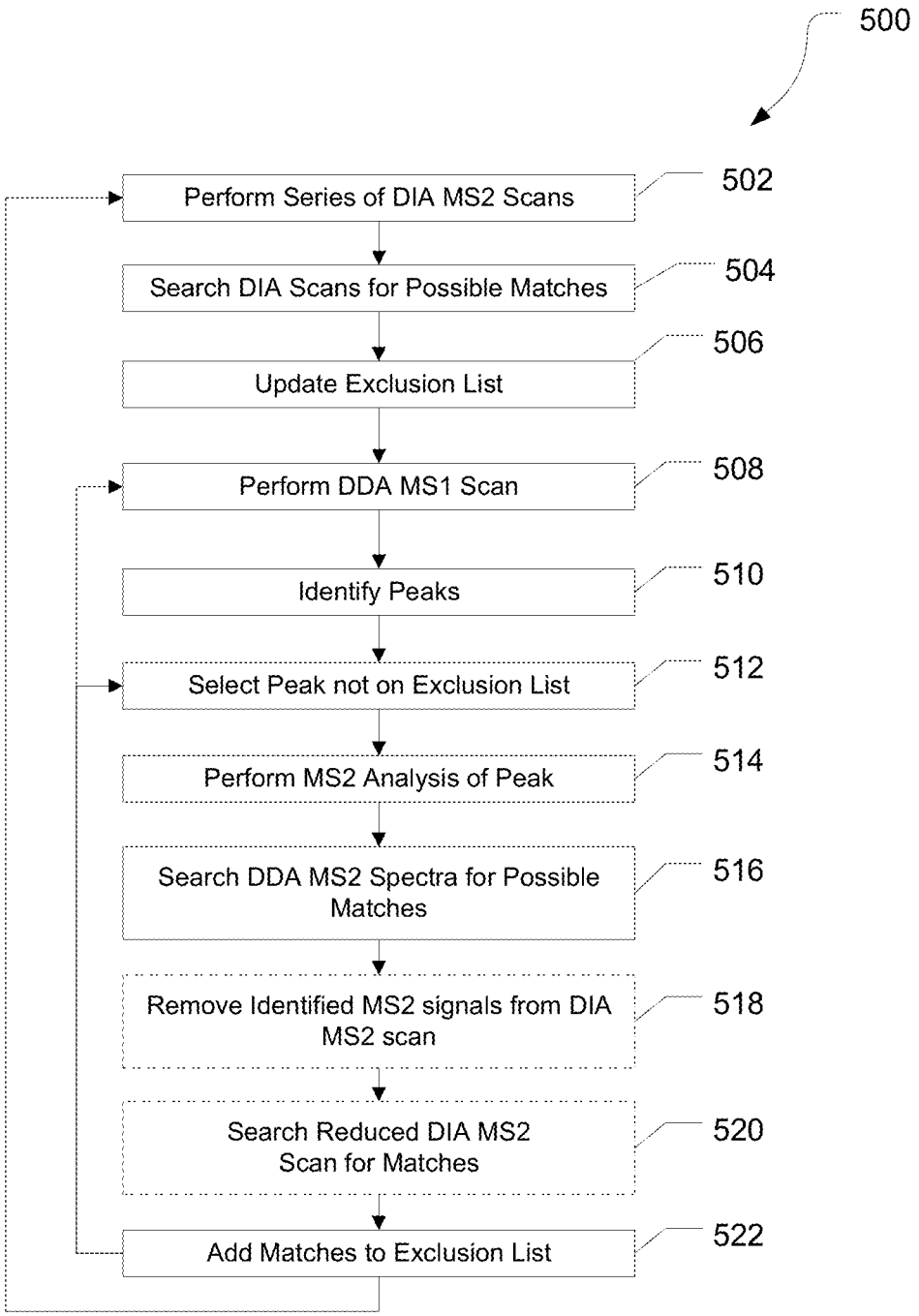

FIG. 5 is a flow diagram illustrating a method of combining data-independent and data-dependent approaches combined with identifying additional precursors in chimeric spectra, in accordance with various embodiments.

Figure 6:
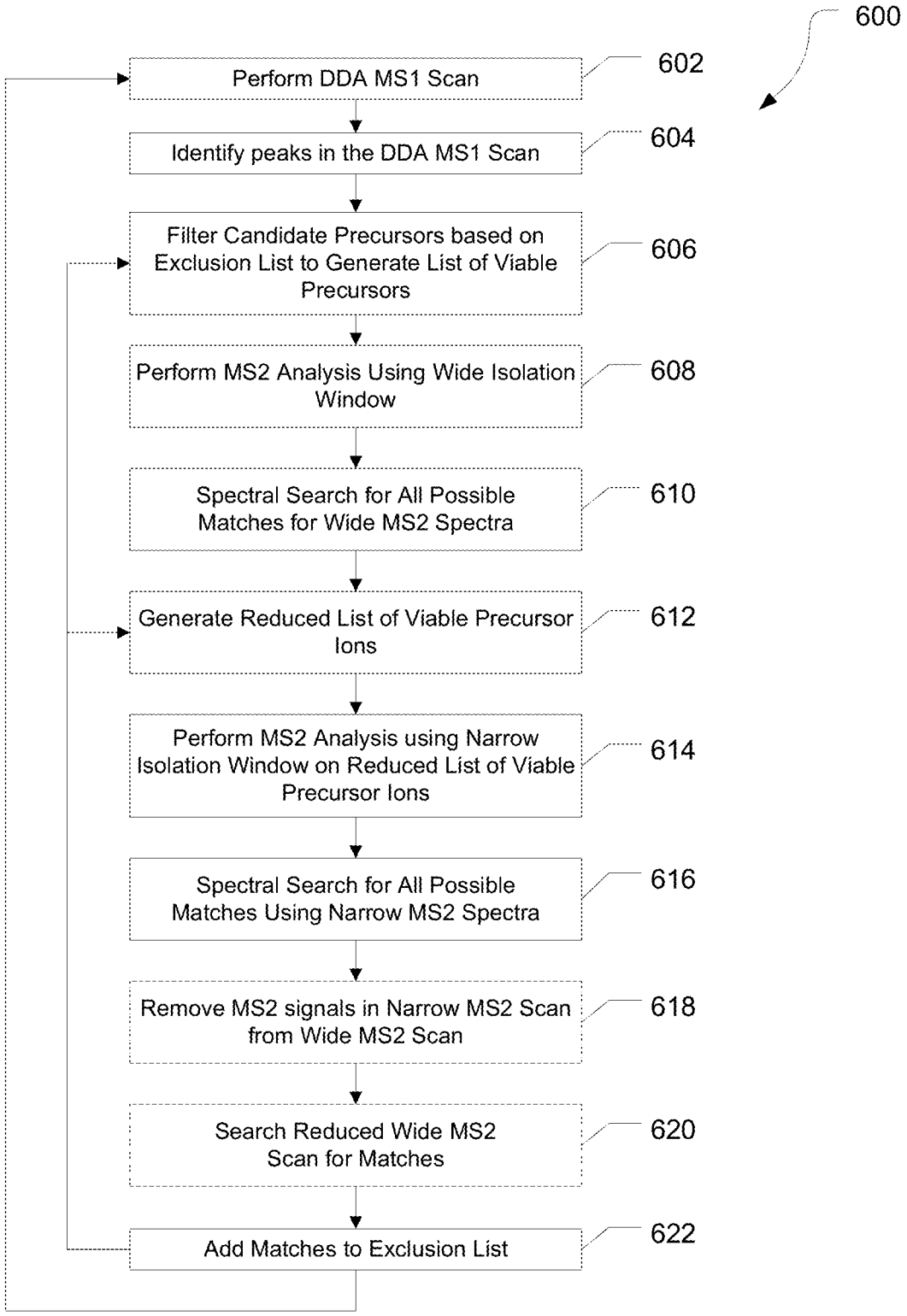

FIG. 6 is a flow diagram illustrating a method of identifying additional precursors in chimeric spectra in a combination of wide and narrow MS2 spectra, in accordance with various embodiments.

Figure 7:
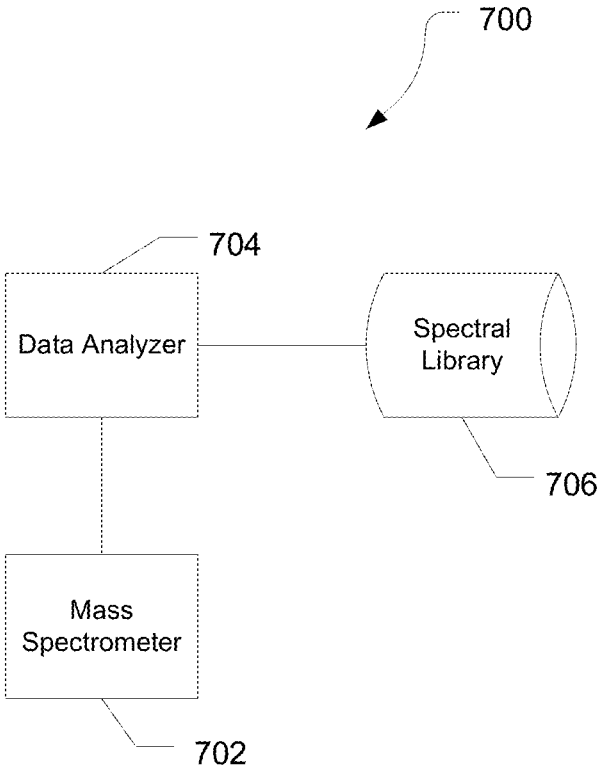

FIG. 7 is a block diagram of an exemplary system for performing data dependent analysis using real time search results to inform peak selection, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods to dynamically exclude product ions that may be present in the master scan are described herein.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Figure 1:
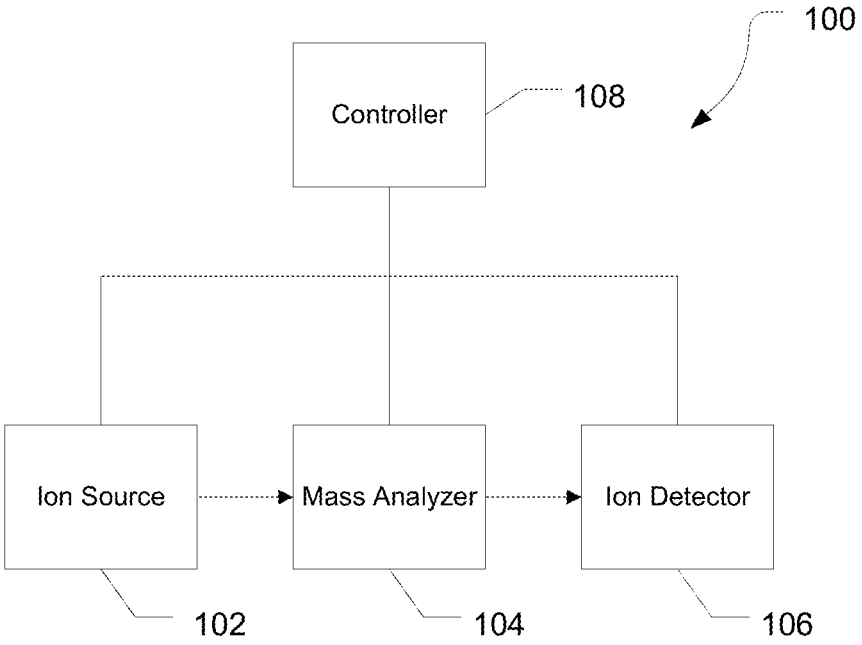
FIG. 1 is a block diagram of an exemplary mass spectrometry system, in accordance with various embodiments.

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 104 can separate ions based on a mass-to-charge ratio (m/z) of the ions. For example, the mass analyzer 104 can include a quadrupole mass filter analyzer, a quadrupole ion trap analyzer, a time-of-flight (TOF) analyzer, an electrostatic trap mass analyzer (e.g., ORBITRAP mass analyzer), Fourier transform ion cyclotron resonance (FT-ICR) mass analyzer, and the like. In various embodiments, the mass analyzer 104 can also be configured to fragment the ions using collision induced dissociation (CID) electron transfer dissociation (ETD), electron capture dissociation (ECD), photo induced dissociation (PID), surface induced dissociation (SID), and the like, and further separate the fragmented ions based on the mass-to-charge ratio.

In various embodiments, the mass spectrometry platform 100 can include multiple mass analyzers. In this way, mass analysis can be performed on two sets of ions at the same time. Additionally, the mass analyzers may have different mass accuracies and/or resolutions, such as a high-resolution electrostatic trap mass analyzer and a lower resolution quadrupole mass analyzer or ion trap mass analyzer.

In various embodiments, the ion detector 106 can detect ions. For example, the ion detector 106 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source 102 or enable/disable the ion source 102. Additionally, the controller 108 can configure the mass analyzer 104 to select a particular mass range to detect. Further, the controller 108 can adjust the sensitivity of the ion detector 106, such as by adjusting the gain. Additionally, the controller 106 can adjust the polarity of the ion detector 106 based on the polarity of the ions being detected. For example, the ion detector 106 can be configured to detect positive ions or be configured to detected negative ions.

Data Dependent Analysis

Figure 2:
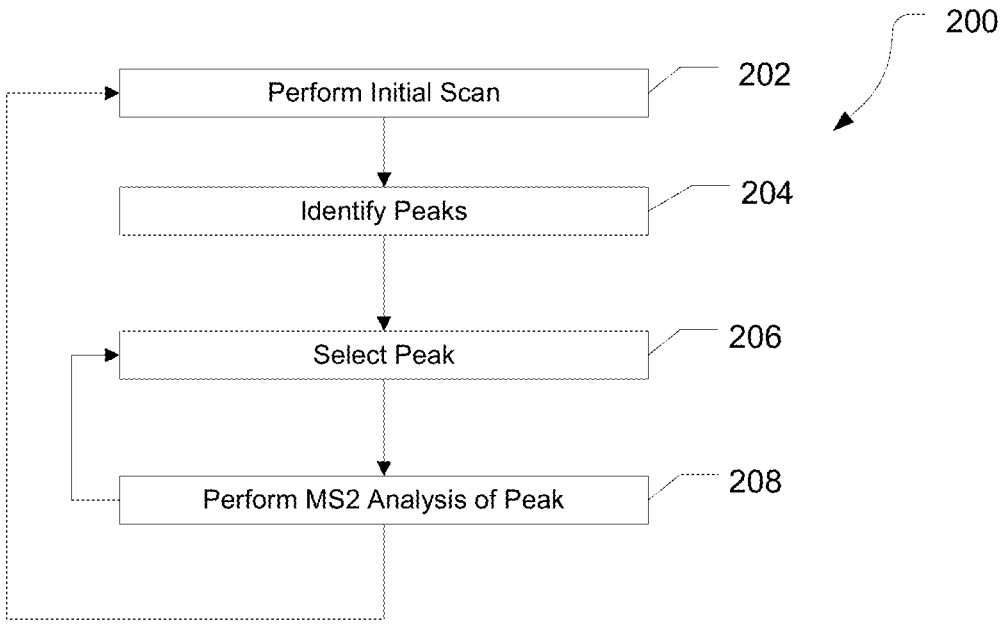
FIG. 2 is a flow diagram illustrating a method data dependent analysis, in accordance with various embodiments.

FIG. 2 is a flow diagram illustrating a method of data dependent analysis 200. At 202, a survey scan can be performed. The survey scan can be used to identify precursor ions present in the ionized eluent for further analysis. Generally, the precursor scan can be performed without fragmentation, such as by utilizing low trapping energy that is below the threshold needed to cause fragmentation.

At 204, peaks can be identified in the survey scan spectra (MS1 spectra). Various techniques are known in the art to identify peaks from a mass spectrum. Typically, some approximation of the center of the peak is used to identify the mass-to-charge ratio of an ion.

At 206, a peak can be selected for analysis. In various embodiments, a precursor ion with the highest abundance can be selected. In other embodiments, precursors may be selected at least in part based on an inclusion list. The inclusion list can include mass-to-charge ratios or m/z ranges of particular interest, and when ions are detected within those ranges, they can be selected for MS2 analysis. In further embodiments, an exclusion list can be used to avoid listed precursor ions, such as a precursor ion that was previously analyzed. Many other criteria have been employed to select ions for analysis. Often these criteria are combined to compromise a list of rules. These additional criteria include but aren't limited too: charge state, monoisotopic m/z assignment, isotope ratio, and mass difference.

At 208, the MS2 analysis can be performed on the selected peak. In the first stage, the precursor ion can be selected based on the mass-to-charge ratio identified from the survey scan. The selected ion can be fragmented to produce product ions and then the mass-to-charge ratios of the product ions can be measured.

After the product ions are measured, another peak can be selected for analysis at 206. Additionally, an additional survey scan at 202 can be performed periodically as the ions and their identities can change throughout a chromatographic run.

Many of the MS2 scans collected during a typical data-dependent LC-MS/MS analysis of a complex sample can be chimeric. A chimeric spectrum contains fragment ions from multiple co-isolated precursors. However, during standard data-dependent analyses with typical dynamic exclusion filter settings, the algorithms for selecting precursor ions may specifically target each of these near isobaric precursors with their own individual MS2 scans. Since the near isobaric precursors can be isolated and fragmented in both of these scans, the MS2 information contained in these separate MS2 spectra is often nearly identical. As such, time that could have been used to collect data on an additional precursor is wasted collecting redundant information.

Many modern data-analysis software packages support searching chimeric spectra. For example, the software can identify near isobaric MS1 precursor ions and search the corresponding MS2 spectra again with this extra precursor information. Researching a typical LC-MS/MS analysis of a complex proteomics sample to identify chimeric spectra often produces >20% more peptide spectral matches (PSMs). However, these PSM gains highlight an inefficiency in how the mass spectrometer is collecting data, often collecting what can be effectively replicate spectra on these near isobaric MS1 features. Ideally, the instrument could identify when it picked up an additional PSM from one of these chimeric spectra, and then intelligently decide to skip over collecting the additional redundant MS2 scan.

Real time search (RTS) can be used to identify all the peptide spectral matches (PSMs) in these chimeric MS2 scans. In various embodiments, RTS can include performing a spectral search during the execution of the experiment and using the search results to inform precursor selection or otherwise modify the ongoing experiment. If RTS successfully identifies additional precursors in a chimeric MS2 scan, then these additional precursor m/z values can also be placed on the dynamic exclusion list. If any near isobaric precursors do not produce an RTS spectral match, then those precursors will not be placed on the exclusion list and the precursors may be targeted in the future by an additional MS2 scans.

Figure 3B:
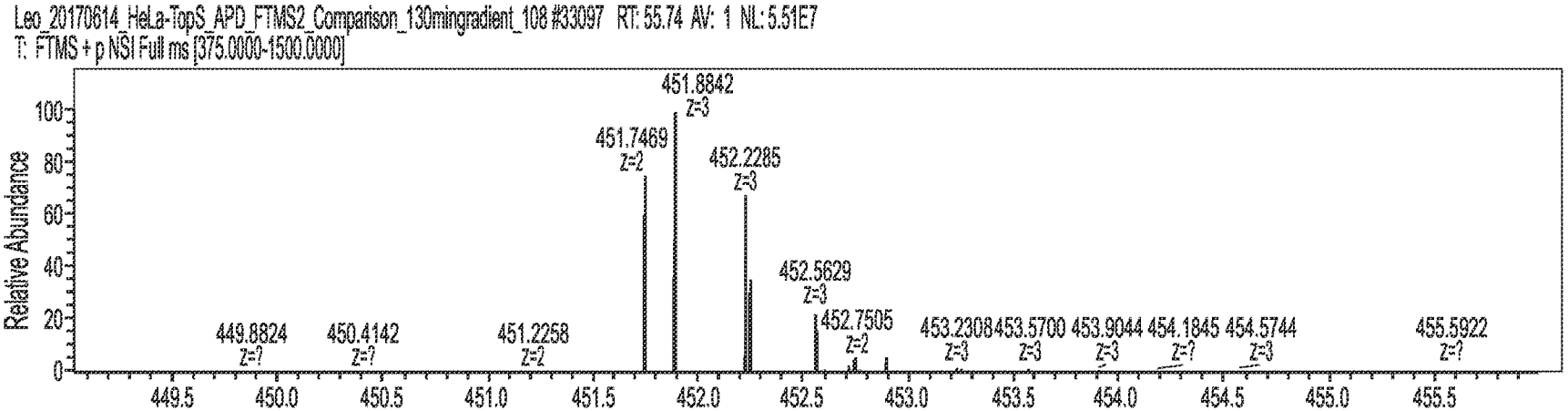
Figure 3C:
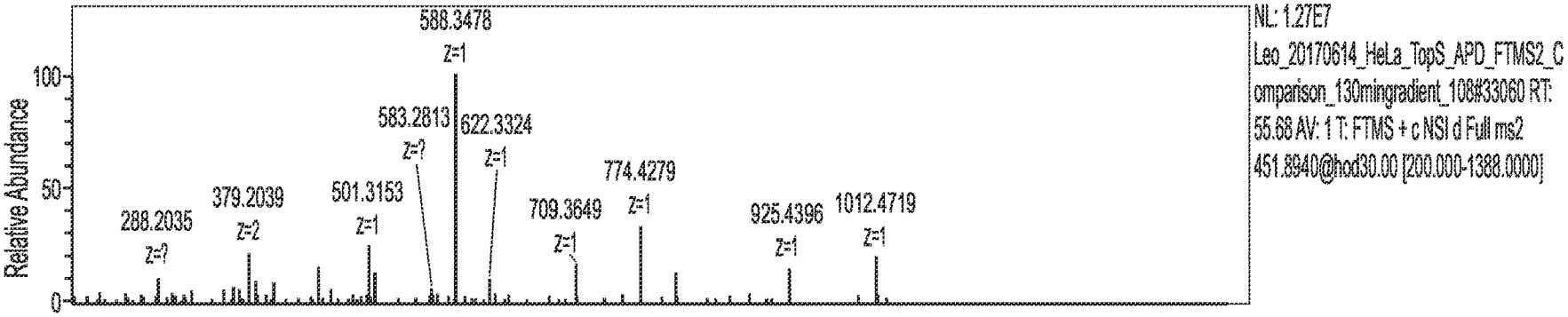
Figure 3D:
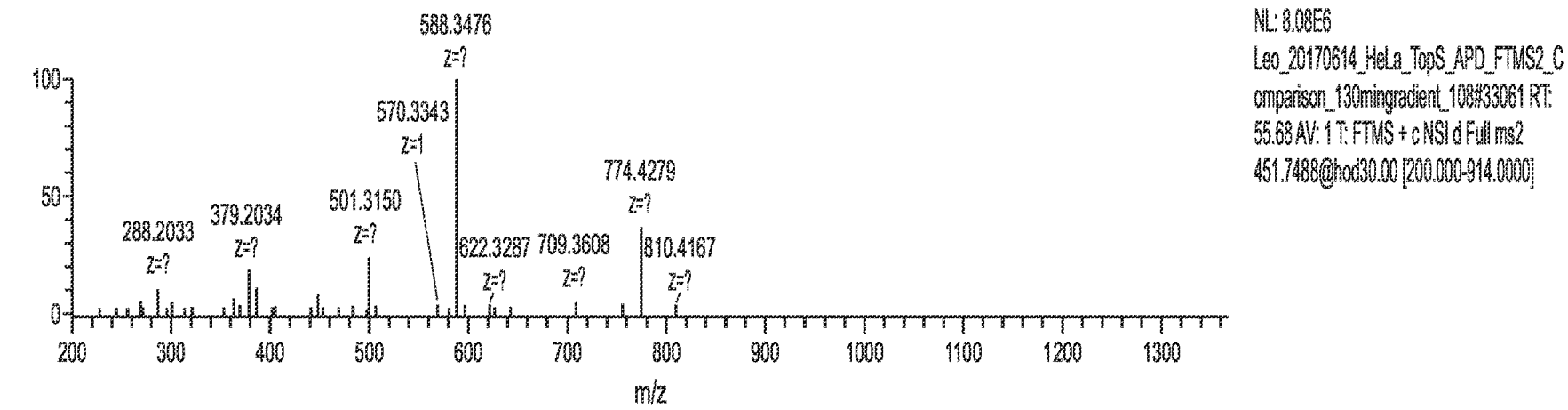
Figure 3E:
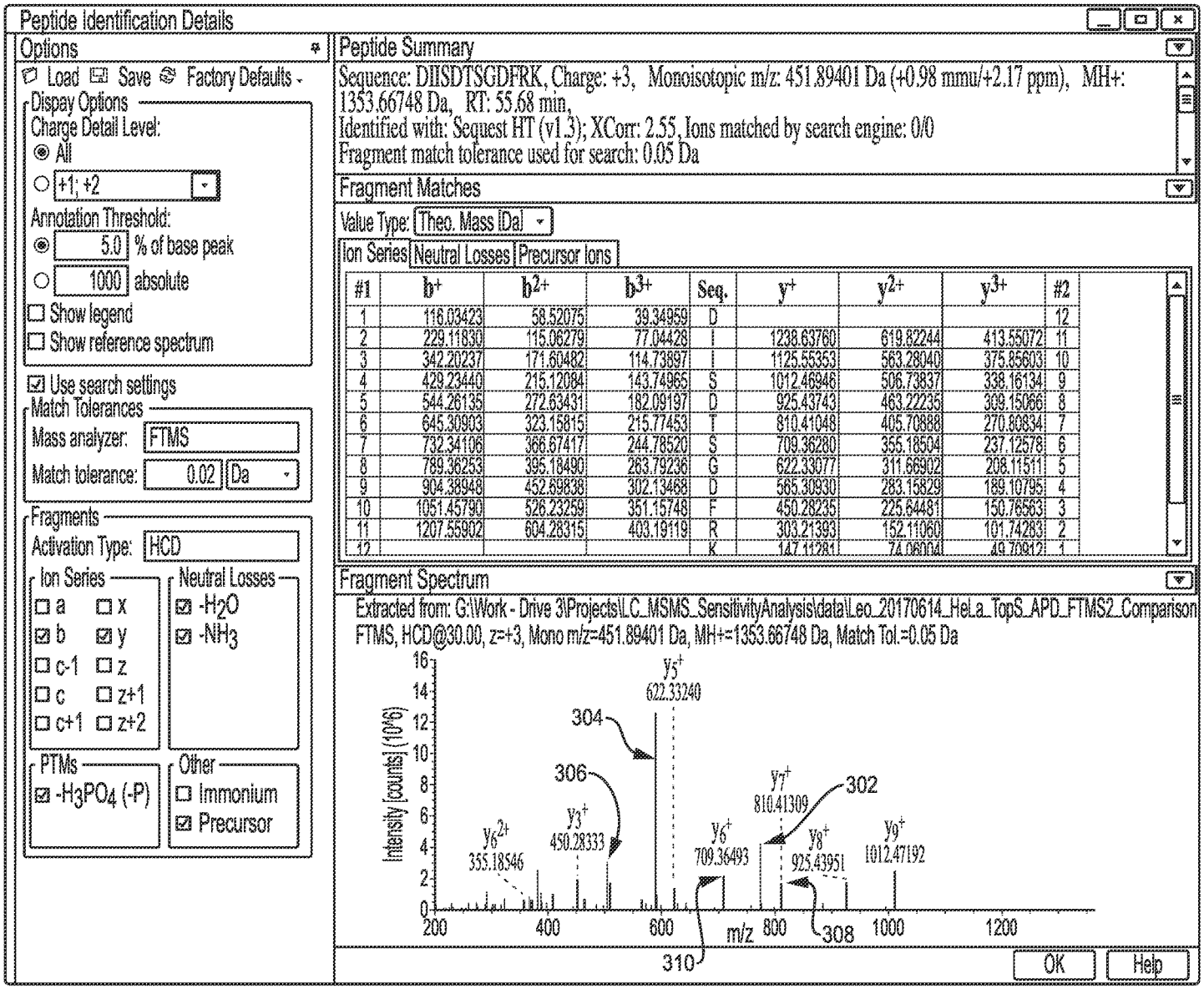
Figure 3F:
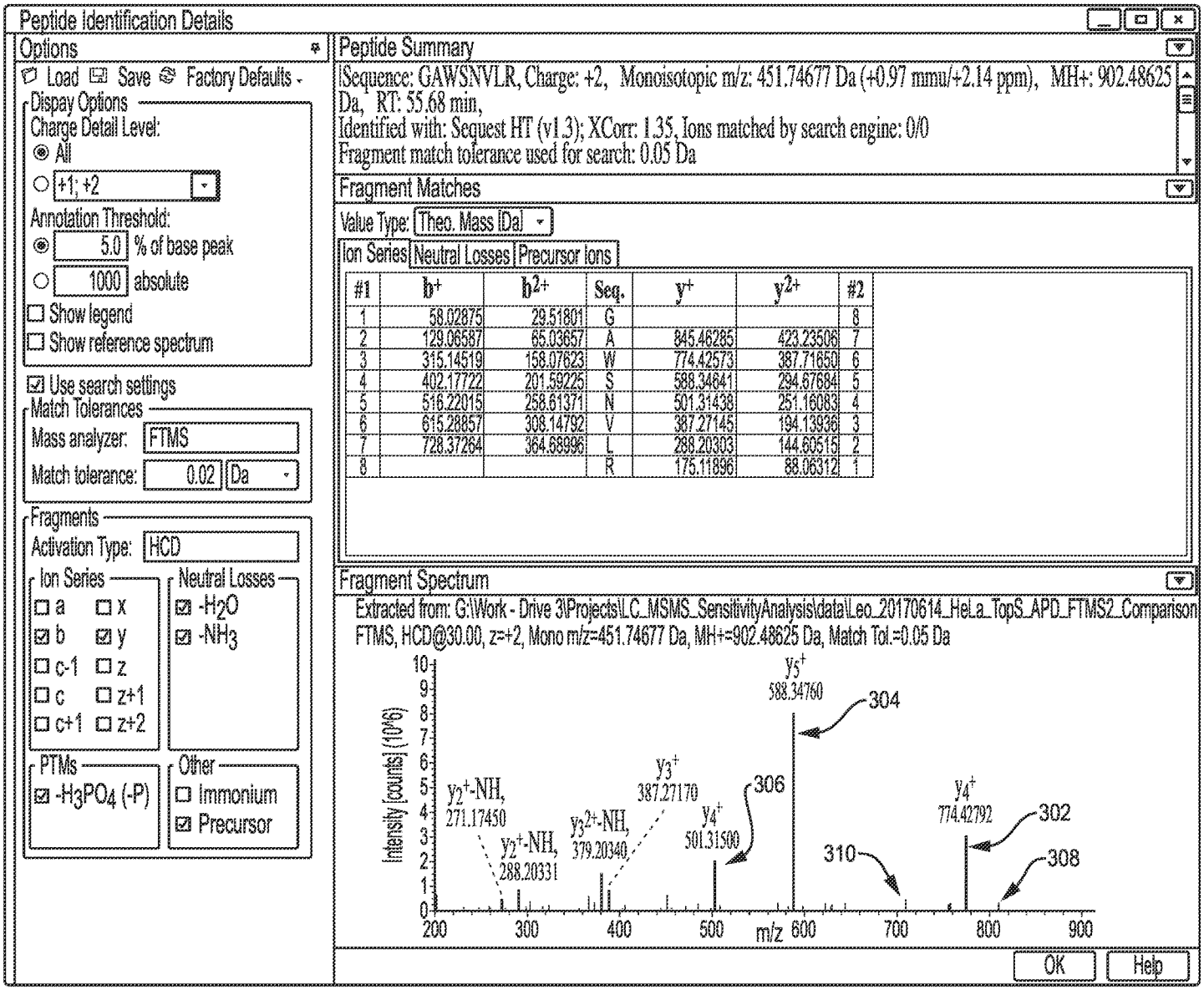

FIGS. 3A-3F present an example where a DDA experiment collected consecutive MS2 scans on near isobaric precursors (<0.2 m/z difference). The mass spectrometer identified the two different precursors in the same MS1 scan, and then the instrument collected back-to-back MS2 scans on both species. FIG. 3A shows the chromatograms (base peak and extracted ion chromatograms for 451.74 and 451.89 m/z). FIG. 3B shows a MS1 spectrum at RT=55.74. Notably, the near isobaric precursors at m/z=451.74 and m/z=451.89 elute at the same retention time. FIG. 3C is the MS2 spectrum for the 451.89 m/z precursor and FIG. 3D is the MS2 spectrum for the 451.74 m/z precursor. While there are some differences between the two MS2 spectra, most of the same product ions appear in both scans. FIGS. 3E and 3F show the identification of the 451.89 m/z precursor and the 451.74 m/z precursor respectively. For example, peaks 302, 304, and 306 are unidentified in FIG. 3E but are identified fragments of the 451.74 m/z precursor as shown in FIG. 3F. Similarly, peaks 308 and 310 are identified fragments of the 451.89 m/z precursor in FIG. 3E but show up as unidentified peaks in FIG. 3F. These data were collected by analyzing a HeLa digest with a data-dependent Fourier Transform MS2 method. Searching these data with Proteome Discoverer 2.5 produced ~6000 more PSMs (40 k vs 46 k) when combined with the "Precursor Detection" node, which deliberately seeks out chimeric MS2 spectra and searches for additional precursors.

This boost in PSMs betrays an inefficiency in MS2 spectra collection during a typical data-dependent method. For most of these chimeric spectra, the near isobaric precursors were each interrogated with their own respective MS2 scans. So even though the "Precursor Detection" algorithm produced an increase in PSMs, there was a much smaller increase in the number of unique peptide IDs (15% vs. 5%). The differences between those relative increases describes a subset of MS2 scans that were unnecessary. The scans contain redundant information that does not add anything to the final analysis when the chimeric spectra are properly searched post-acquisition.

FIG. 4 shows a method 400 using real time search (RTS) to overcome the inefficiency caused by performing redundant scans on near isomeric precursors. At 402, an initial MS1 scan is performed, and at 404, potential precursor ions (mass peaks) can be identified in the MS1 scan. At 406, a peak that is not on the exclusion list can be selected for additional analysis. In various embodiments, the exclusion list can include previously identified precursors. At 408, a MS2 analysis can be performed on the peak. In various embodiments, the MS2 analysis can involve isolating precursor ions within a narrow mass range at the peak and fragmenting the precursor ions. In various embodiments, the MS2 analysis can have an isolation window of at least about 0.4 m/z and not greater than about 10 m/z, such as not greater than about 5 m/z, even not greater than about 2 m/z.

At 410, a real time spectral search can be used to identify all possible matches using the MS2 spectra. In various embodiments, this can include using the fragment ions to identify a precursor ion having the target m/z as well as near isobaric precursor ions with m/z within the isolation window. In various embodiments, the search for additional precursors can be based on other precursors peaks found in the MS1 scan. Alternatively, the additional searches can be based on a list of theoretical precursors generated based on the isolation window of the MS2 analysis. At 412, all identified precursors, including the targeted precursor, can be added to the exclusion list. In various embodiments, the targeted precursor can be added to the exclusion list even if the targeted precursor cannot be identified. Identifying additional precursors from the MS2 analysis and adding them to the exclusion list can avoid performing a second MS2 analysis of near isobaric precursor ion that can be identified from the first MS2 analysis. This increased efficiency affords additional time that can be spent going after unique precursor ions.

After the identified precursors are added to the exclusion list, another peak can be selected at 406 for MS2 analysis or another MS1 scan can be performed. Generally, several MS2 analyses are performed based on each MS1 scan, but multiple MS1 scans can be collected throughout a chromatographic run.

While the examples provided show a standard proteomics data-dependent MS2 method with a basic database query for the real time search, one of skill in the art would recognize that the approach can be extended to other applications such as small molecules, other MSn levels where n is greater than 2, and other real time search techniques like spectral matching. Further extensions of the on-line real time search could involve more advanced approaches to searching chimeric spectra, for example spectral subtraction and convolved fitting of multiple MS2 populations.

Hybrid Analysis

The general concept of using RTS to search chimeric spectra can be extended out to include more advanced workflows that utilize hybrid data independent analysis (DIA)/DDA and DDA/DDA methods, wherein the first DIA or DDA scan utilizes wider isolation windows than the DDA scan in the "second round" of analysis.

FIG. 5 shows a method 500 for combining DIA and DDA techniques using RTS. At 502, a series of DIA scans can be collected. Generally, this involves dividing up a mass range into subranges and collecting MS2 scans for each of the subranges. At 504, RTS can be used to search the DIA MS2 scans for possible matches. As the width of the isolation window for the DIA MS2 scan is larger than the typical isolation window width for a targeted or DDA MS2 scan, there can be more precursor ions isolated in each DIA MS2 scan making it more difficult to deconvolve the spectra and identify all the precursor ions. However, it is generally possible to identify at least some precursor ions at this stage. At 506, the exclusion list can be updated to include any precursors identified from the DIA MS2 scans.

At 508, a DDA MS1 scan can be collected, and, at 510, peaks can be identified. At 512, a peak can be selected that are not on the exclusion list. As the exclusion list includes precursor ions identified from the DIA scans, these precursors would not be selected for further analysis. At 514, a DDA MS2 analysis of the peak can be performed. At 516, RTS of the DDA MS2 scan can be performed to identify the target precursor as well as any near isobaric precursors within the isolation window of the DDA MS2 scan. At this point, the exclusion list may optionally be updated to include any precursors identified from the DDA MS2 scans. In various embodiments, the target precursor can be added to the exclusion list even if the target precursor cannot be identified.

Optionally, at 518, the identified signals can be removed from the DIA MS2 scans. In various embodiments, fragment peaks corresponding to identified precursor ions can be subtracted from the DIA MS2 scan. At 520, the reduced MS2 scans can be searched for additional precursor matches. With fewer peaks in the reduced scan data, it can be possible to identify additional precursors. The viability of this demultiplexing approach can depend upon the timing of these DIA and DDA experiment cycles and how the DIA and DDA spectral qualities align.

At 522, the identified precursors from the DDA MS2 scans and, optionally, the reduced DIA MS2 scans can be added to the exclusion list. Next, an additional peak can be identified from the DDA MS1 scan at 512, an additional DDA MS1 scan can be collected at 508, or an additional series of DIA MS2 scans can be collected at 502. Generally, the method can return to 512 to identify additional peaks for DDA MS2 analysis as long as there are additional peaks in the DDA MS1 scan that are not on the exclusion list or until a certain time has elapsed and there is a need for an additional DDA MS1 scan or another series of DIA MS2 scans. The exact balance of DDA to DIA scans, and the time allotted for DDA and DIA scan collection will vary depending upon the sample and chromatographic conditions.

In various embodiments, the width of the isolation window for the DDA MS2 scan can be at least about 0.2 m/z, such as at least about 0.4 m/z, and not greater than about 10 m/z, such as not greater than about 5 m/z, even not greater than about 2 m/z. The isolation window for the DIA MS2 scan can be wider than the width of the isolation window for the DDA MS2 scan, such as at least about 2.5 m/z, such as at least about 5 m/z, and not greater than about 30 m/z, such as not greater than about 20 m/z. Generally, the width of isolation window for the DIA MS2 scan can be at least about two times the width of the isolation window for the DDA MS2 scan, such as at least about 4 times the width of the isolation window for the DDA MS2 scan. The width of isolation window for the DIA MS2 scan may not be greater than about 50 times the width of the isolation window for the DDA MS2 scan, such as not greater than about 10 times the width of the isolation window for the DDA MS2 scan.

FIG. 6 shows a method 600 for performing an initial round of MS2 scans using large isolation windows and a second round of MS2 scans with narrower isolation windows to target harder to identify MS1 features. At 602, a DDA MS1 scan can be collected, and, at 604, peaks can be identified. At 606, candidate precursors can be fielded based on the exclusion list to generate a list of viable precursors. At 608, a MS2 analysis with a wide isolation window can be performed. The wide isolation window can be aligned to encompass a number of viable precursors. In various embodiments, the wide isolation windows can be selected to divide up the MS1 scan range based on the distribution of viable precursors. The divisions can be determined based on the number of peaks in a region of the MS1 spectra, such that areas with higher peak density may have smaller isolation windows than areas with lower peak densities, or the division can be based on the ion intensity in a region of the MS1 spectra, such that areas with more intense peaks may have smaller isolation windows than areas with less intense peaks, or any combination thereof. Collecting more spectra in areas with higher peak density can reduce the complexity of the wide MS2 spectra in these regions which may make it possible to identify a larger portion of the precursors at this state. Collecting more spectra in areas with higher intensity can balance the ion flux across the MS2 spectra which may increase sensitivity to less intense precursor ions and minimize space charge effects which may be particularly problematic in mass spectrometers using ion traps and trap-like devices that have a limited charge capacity and dynamic range. At 610, RTS of the wide MS2 scan can be performed to identify the target precursor as well as any precursors within the isolation window of the wide MS2 scan.

At 612, a reduced list of viable precursors can be generated by removing precursors identified from the wide MS2 scan. At 614, a narrow MS2 analysis with a narrow isolation window targeting specific precursor ions from the reduced viable precursor list can be performed. As precursor ions identified from the wide MS2 scans have been removed from the reduced list of viable precursor ions, previously identified precursor ions would not be selected for further analysis. At 616, RTS of the narrow MS2 scan can be performed to identify the target precursor as well as any near isobaric precursors within the isolation window of the narrow MS2 scan.

Optionally, at 618, the identified signals can be removed from the wide MS2 scans. In various embodiments, fragment peaks corresponding to identified precursor ions can be subtracted from the wide MS2 scan. At 620, the reduced wide MS2 scans can be searched for additional precursor matches. With fewer peaks in the reduced scan data, it can be possible to identify additional precursors.

At 622, the identified precursors from the DDA MS2 scans and, optionally, the reduced DIA MS2 scans can be added to the exclusion list. In various embodiments, the targeted precursor by the narrow MS2 scans can be added to the exclusion list even if they are not able to be identified by the real-time search. Next, the reduced list of viable precursor ions can be updated at 612 and an additional MS2 analysis of another precursor identified from the reduced list of viable precursor ions can be performed at 614, candidate precursors can be filtered based on the updated exclusion list at 606 and an additional wide MS analysis can be obtained at 608, or an additional MS1 scan can be collected at 602. Generally, the method can return to 612 to identify additional peaks for DDA MS2 analysis as long as there are additional peaks in the DDA MS1 scan that are not on the exclusion list or until a certain time has elapsed and there is a need for an additional DDA MS1 scan.

In various embodiments, the width of the isolation window for the narrow MS2 scan can be at least about 0.2 m/z, such as at least about 0.4 m/z, and not greater than about 10 m/z, such as not greater than about 5 m/z, even not greater than about 2 m/z. The isolation window for the wide MS2 scan can be wider than the width of the isolation window for the narrow MS2 scan, such as at least about 2.5 m/z, such as at least about 5 m/z, and not greater than about 30 m/z, such as not greater than about 20 m/z. Generally, the width of isolation window for the wide MS2 scan can be at least about two times the width of the isolation window for the narrow MS2 scan, such as at least about 4 times the width of the isolation window for the narrow MS2 scan. The width of isolation window for the wide MS2 scan may not be greater than about 50 times the width of the isolation window for the narrow MS2 scan, such as not greater than about 10 times the width of the isolation window for the narrow MS2 scan.

FIG. 7 illustrates a system 700 for performing data dependent analysis using real-time spectral matching. The system can include a mass spectrometer 702, such as mass spectrometer 100 in FIG. 1, a data analyzer 704, and a spectral library 706. In various embodiments, the data analyzer 704 and the spectral library 706 can reside locally with the mass spectrometer 702, such as on a computer system controlling the mass spectrometer 702. In other embodiments, the data analyzer 704 can reside locally with the mass spectrometer 702 and the spectral library 706 can be cloud based. With a cloud based spectral library 706, it can be advantageous for the data analyzer 704 to locally cache a portion of the spectral library 706. In yet another embodiment, the data analyzer 704 and the spectral library 706 can be cloud based.

Mass spectrometer 702 can provide an MS2 spectrum to data analyzer 704. Data analyzer 704 can perform spectral matching of the MS2 spectra to the spectral library 706 and can identify the compound. Additionally, data analyzer 704 can identify fragment ions of the compound either through simulation or based on the spectral library 706. Data analyzer 704 can provide an exclusion list of fragment ions to the mass spectrometer 702. Mass spectrometer 702 can perform additional analysis based on the exclusion list.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A method comprising:

obtaining a first mass spectrum;

selecting a first peak of the first mass spectrum;

isolating precursor ions in an isolation window including the first peak;

fragmenting and analyzing the isolated ions to obtain a second mass spectrum;

performing a real-time search of the second mass spectrum for both a target precursor of the first peak and near isobaric precursors ions that are co-isolated with the target precursor in the isolation window, wherein the near isobaric precursor ions have an exact mass difference of less than 0.2 m/z from the target precursor's exact mass;

adding the near isobaric precursor ions that produced an identification during the real-time search to an exclusion list;

selecting a second peak present in the first mass spectrum and not on the exclusion list; and fragmenting and analyzing ions of the second peak to obtain a third mass spectrum.

2. The method of claim 1, wherein the isolation window has a width of less than about 10 m/z.

3. The method of claim 1, further comprising adding the target precursor to the exclusion list irrespective of whether or not it produced an identification during the real-time search.

4. The method of claim 1, prior to selecting the first peak of the first mass spectrum, further comprising:

isolating precursor ions in a second isolation window having a width greater than a width of the isolation window;

fragmenting and analyzing the isolated ions to obtain a fourth mass spectrum;

performing a real-time search of the fourth mass spectrum for a set of precursor ions co-isolated in the second isolation window; and adding the set of precursor ions to the exclusion list.

5. The method of claim 4, wherein the width of the second isolation window is at least about two times the width of the isolation window.

6. The method of claim 4, wherein the second isolation window is selected based on the location of a plurality of peaks in first mass spectrum.

7. The method of claim 6, wherein the second isolation window is selected based on the number of precursor ion peaks within the second isolation window.

8. The method of claim 6, wherein the second isolation window is selected based on the precursor ion flux isolated with the second isolation window.

9. A method comprising:

isolating precursor ions in a first isolation window having a first width;

fragmenting and analyzing the isolated ions to obtain a first mass spectrum;

performing a first real-time search of the first mass spectrum for a first set of precursor ions co- isolated in the first isolation window;

adding precursor ions in the first set that produced an identification during the first real-time search to an exclusion list;

selecting an unidentified precursor peak not on the exclusion list;

isolating precursor ions in a second isolation window having a second width, the second width narrower than the first width and centered on the unidentified precursor peak;

fragmenting and analyzing the isolated ions to obtain a second mass spectrum;

performing a second real-time search of the second mass spectrum for both a target precursor of the unidentified precursor peak and near isobaric precursors that have been co-isolated with the target precursor in the second isolation window, wherein the near isobaric precursors have an exact mass difference of less than 0.2 m/z from the target precursor's exact mass;

removing features corresponding to fragments of the second set of precursor ions identified during the real-time search of the second mass spectrum from the first mass spectrum to obtain a reduced mass spectrum;

adding precursor ions in the second set that produced an identification during the second real-time search to the exclusion list;

performing a third real-time search of the reduced mass spectrum for a third set of precursor ions co-isolated in the first isolation window;

adding precursor ions in the third set that produced an identification during the third real-time search to the exclusion list;

selecting a second unidentified peak not on the exclusion list; and fragmenting and analyzing ions of the second unidentified peak to obtain a third mass spectrum.

10. A mass spectrometer comprising:

an ion source configured to ionize a sample to produce ions;

a mass analyzer configured to produce mass spectra; and a controller configured to obtain a first mass spectrum;

select a first peak of the first mass spectrum;

isolate precursor ions in an isolation window including the first peak;

fragment and analyzing the isolated ions to obtain a second mass spectrum;

perform a real-time search of the second mass spectrum for both a target precursor of the first peak and near isobaric precursors ions that have been co-isolated with the target precursor in the isolation window, wherein the near isobaric precursor ions have an exact mass difference of less than 0.2 m/z from the target precursor's exact mass;

add the near isobaric precursor ions that produced an identification during the real-time search to an exclusion list;

select a second peak present in the first mass spectrum and not on the exclusion list; and fragment and analyze ions of the second peak to obtain a third mass spectrum.

11. The mass spectrometer of claim 10, wherein the isolation window has a width of less than about 10 m/z.

12. The mass spectrometer of claim 10, wherein the controller is further configured to, prior to selecting the first peak of the first mass spectrum:

isolate precursor ions in a second isolation window having a width greater than a width of the isolation window;

fragment and analyzing the isolated ions to obtain a fourth mass spectrum;

perform a real-time search of the fourth mass spectrum for a set of precursor ions co-isolated in the second isolation window; and add the set of precursor ions to the exclusion list.

13. The mass spectrometer of claim 12, wherein the width of the second isolation window is at least about two times the width of the isolation window.

14. The mass spectrometer of claim 12, wherein the second isolation window is selected based on the location of a plurality of peaks in first mass spectrum.

15. The mass spectrometer of claim 14, wherein the second isolation window is selected based on the number of precursor ion peaks within the second isolation window.

16. The mass spectrometer of claim 14, wherein the second isolation window is selected based on the precursor ion flux isolated with the second isolation window.

* * * * *